United States Patent [19]

Karkas

[11] 3,933,286

[45] Jan. 20, 1976

[54] PIN CUSHION AND METHOD OF MAKING SAME

[76] Inventor: Esko Kullerno Karkas, 22 Howland Road, Toronto, Ontario, Canada, M4K 226

[22] Filed: Jan. 29, 1974

[21] Appl. No.: 437,711

[52] U.S. Cl. ..... 224/28 P; 223/109

[51] Int. Cl.[2] ..... A44C 5/00

[58] Field of Search..... 223/106, 107, 108, 109 R, 223/109; 2/21; 224/28 B, 28 C, 28 A, 28 D, 28 P

[56] References Cited

UNITED STATES PATENTS

| | | | |
|---|---|---|---|
| 853,577 | 5/1907 | Connell | 224/28 P |
| 2,058,340 | 10/1936 | Miller | 223/109 R |
| 2,456,445 | 12/1948 | Rees et al. | 224/28 P |
| 2,543,521 | 2/1951 | Brody | 2/21 |
| 2,600,092 | 6/1952 | Buelow | 224/28 P |

*Primary Examiner*—George H. Krizmanich

[57] ABSTRACT

A pin cushion and a simple method for making same are disclosed, the pin cushion being adapted to conveniently engage the wrist or arm of a wearer and having protective side walls engaging the cushion material. The pin cushion is formed by heating and bending substantially cruciform shaped thermoplastic sheet material into a holder having an upwardly extending channel and downwardly extending jaws which can clamp the arm or wrist of a user, the cushion material being inserted into the channel.

1 Claim, 3 Drawing Figures

PIN CUSHION AND METHOD OF MAKING SAME

BACKGROUND OF THE INVENTION

1. Field of the Invention

This invention relates to a pin cushion and a process for making a pin cushion.

2. Description of the Prior Art

Pin cushions in common use generally comprise soft material of three-dimensional configuration into which pins are inserted, so that the pins are readily available for use. However, it often happens that a pin cushion will be misplaced or be out of reach of a user, causing the user to lose time.

SUMMARY OF THE INVENTION

The present invention provides a simply constructed pin cushion adapted to be worn on the wrist or arm of a user and having protective opposing side walls engaging the cushion material. A simple method is provided for making such a pin cushion from a flat sheet of thermoplastic material and a block of cushion material. The advantages of the invention will become apparent from the following description of a preferred embodiment of the invention illustrated in the accompanying drawings.

DESCRIPTION OF THE PREFERRED EMBODIMENT

Figure 1:
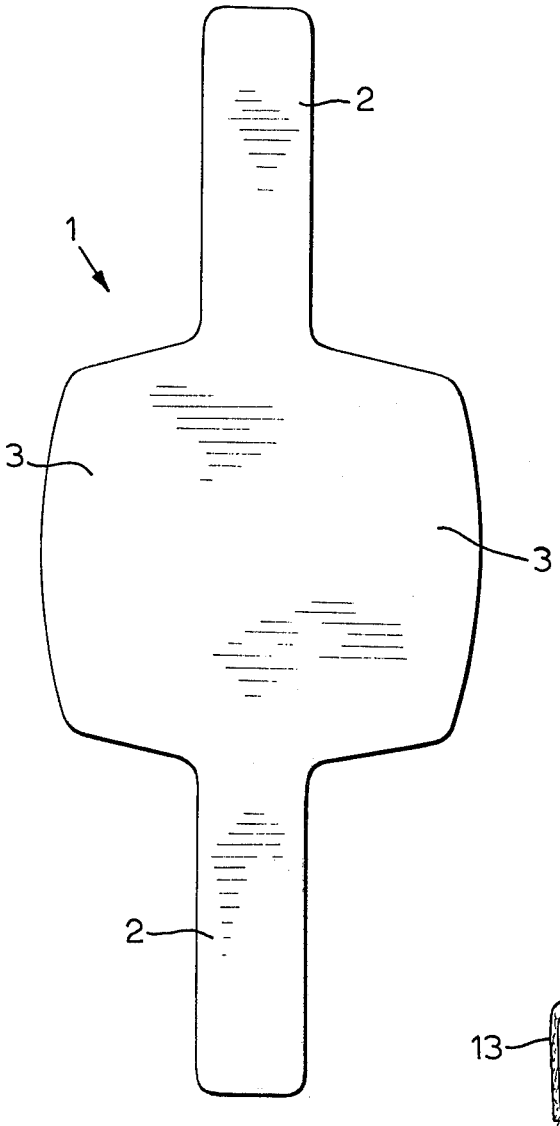
FIG. 1 is a plan view of a one-piece substantially cruciform shaped flat sheet of thermoplastic material for use in making the holder portion of a pin cushion.
Figure 2:
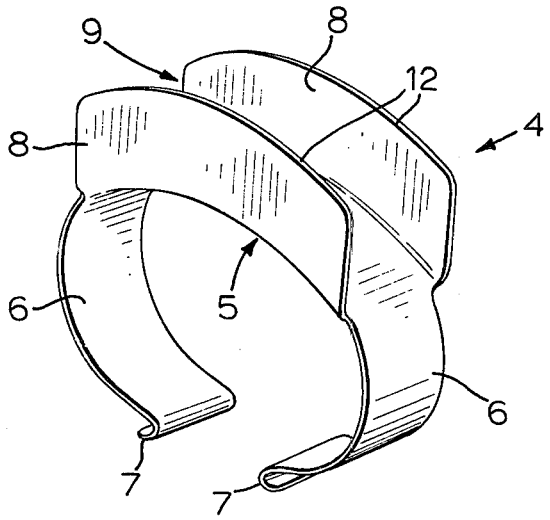
FIG. 2 is a perspective view of a holder formed from the sheet of FIG. 1.
Figure 3:
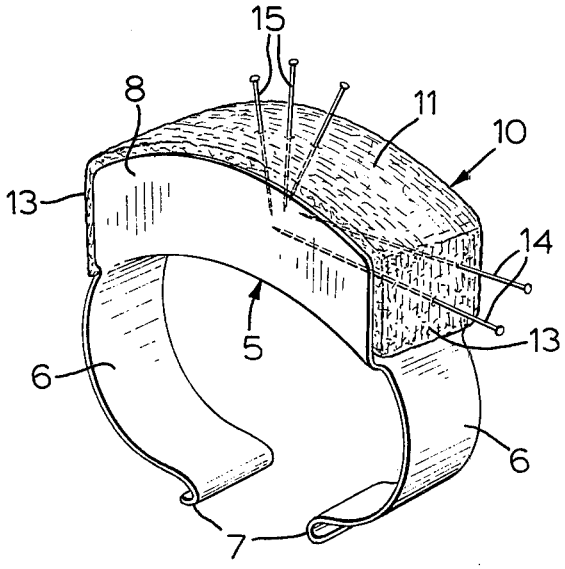
FIG. 3 is a perspective view of a completed pin cushion.

Referring to FIG. 1, in the construction of a preferred embodiment flat thermoplastic sheet material is cut into a one-piece substantially cruciform shape. This cut material, indicated generally by reference numeral 1, is bent and shaped with the application of heat both laterally and longitudinally to form the pin cushion holder of FIG. 2 indicated by reference numeral 4. The segments 2 are bent generally downward to form flexible arcuate jaws 6 while the segments 3 are bent upward to form protective opposing side walls 8.

The resultant holder has a band 5 terminating in flexible arcuate jaws 6 with outwardly turned tips 7 to facilitate pressing the holder onto one's wrist or arm. The holder also has upwardly extending protective opposing side walls 8 forming a channel 9 extending in the direction of the band 5.

A pad of cushion material, indicated generally by 10, is cut and glued into the channel 9, the side walls 8 engaging the cushion material, the top of said cushion material 11 being substantially flush with the top edges 12 of the side wall but preferably extending slightly above the said top edges of the side walls. The ends of the cushion material 13 are exposed by reason of the open channel ends to allow insertion of longer pins 14 substantially parallel to the band 5. The material is preferably fibrous, and in particular of thick felt, the fibres running in a direction substantially normal to the band 5 to facilitate the insertion of pins 15 in this general direction.

What I claim is:

1. A pin cushion comprising a holder constituted by a unitary piece of thermoplastics material in the form of an arcuate wrist-covering band having its ends bent into flexible arcuate jaws adapted to engage around the wrist of the user, and having side walls extending along opposing side edges of the central arcuate portion of the band, and extending upwardly from said band and defining an open-ended channel therebetween and cushion material snugly received and secured in the channel between the side walls, the cushion material being of a shape complementary to said channel and composed of fibrous felt arranged with its fibers running in a direction substantially normal to the band and the surface of said material being directly exposed at the top and ends of said channel.

* * * * *